US008201570B2

(12) United States Patent
Froelicher

(10) Patent No.: US 8,201,570 B2
(45) Date of Patent: Jun. 19, 2012

(54) DISHWASHER DRAWER GASKET SYSTEM

(75) Inventor: Steve B. Froelicher, Shepherdsville, KY (US)

(73) Assignee: General Electric Company, Schenectady, NY (US)

( * ) Notice: Subject to any disclaimer, the term of this patent is extended or adjusted under 35 U.S.C. 154(b) by 321 days.

(21) Appl. No.: 12/604,833

(22) Filed: Oct. 23, 2009

(65) Prior Publication Data

US 2011/0095029 A1 Apr. 28, 2011

(51) Int. Cl.
*B08B 3/02* (2006.01)

(52) U.S. Cl. ..... 134/200; 134/186; 134/172

(58) Field of Classification Search ..... 134/57 D, 134/172, 176, 13, 200
See application file for complete search history.

(56) References Cited

U.S. PATENT DOCUMENTS

| | | | | |
|---|---|---|---|---|
| 2,455,182 | A * | 11/1948 | La Vallee | 62/131 |
| 2,654,386 | A * | 10/1953 | Wotring | 137/216.1 |
| 2,668,091 | A * | 2/1954 | Clark | 312/270.3 |
| 2,846,286 | A * | 8/1958 | Gomersall | 312/270.3 |
| 6,491,049 | B1 | 12/2002 | Tuller et al. | |
| 7,152,612 | B1 | 12/2006 | Maunsell et al. | |
| 7,201,175 | B2 | 4/2007 | DeBoer et al. | |
| 7,607,444 | B2 * | 10/2009 | Gunnerson et al. | 134/200 |
| 2007/0119485 | A1 | 5/2007 | Gunnerson et al. | |

FOREIGN PATENT DOCUMENTS

| | | | |
|---|---|---|---|
| JP | 2002-051959 | * | 2/2002 |
| JP | 2002-325714 | * | 11/2002 |
| JP | 2004-194695 | * | 7/2004 |
| JP | 2005-058372 | * | 3/2005 |
| JP | 2007-097780 | * | 4/2007 |
| JP | 2007-325810 | * | 12/2007 |
| JP | 2008-000448 | * | 1/2008 |
| JP | 2008-093047 | * | 4/2008 |
| JP | 2008-167918 | * | 7/2008 |
| WO | WO 2006/089622 A1 | | 8/2006 |

OTHER PUBLICATIONS

European Patent Office 0 778 227 Jun. 1997.*

* cited by examiner

*Primary Examiner* — Frankie L Stinson
(74) *Attorney, Agent, or Firm* — Fay Sharpe LLP

(57) ABSTRACT

A cover assembly for sealing a dishwasher drawer includes a rigid, movable cover casing that frames a flexible sealing cover which is capable of receiving and covering tall dishes extending beyond a height of the drawer. Rocker arms are placed on each perimeter edge of the cover casing, and pivot to raise and lower the casing onto the drawer so that the sealing cover seals a wash chamber therein. A seal adhered to a bottom of the cover casing presses against a lip of the drawer to prevent leakage of wash fluid circulated therein.

21 Claims, 6 Drawing Sheets

DISHWASHER DRAWER GASKET SYSTEM

BACKGROUND OF THE DISCLOSURE

The present disclosure pertains to the art of dishwashers and, more particularly, to a dishwasher sealing gasket mechanism for a drawer-type dishwasher.

Dishwashers having pull-out drawers have been well known in the art for some time. Some dishwashers include an upper, pull-out drawer forming a washing chamber for washing smaller objects, and a lower dishwasher. Other dishwashers include both upper and lower pull-out type washing chambers, or a single pull-out type washing chamber. Washing chambers have a lid with a water-tight seal to prevent washing fluid from leaking from the dishwasher during a washing operation.

A lid is pivotally mounted to the dishwasher above the washing chamber. The lid is raised from the washing chamber when the drawer is withdrawn from the dishwasher, and lowered onto the washing chamber when the drawer is inserted back into the dishwasher. A seal or gasket is provided on either the lid or the washing chamber. For example, a seal or gasket is provided at a peripheral portion of the lid.

Force is required to seat the lid against the washing chamber to ensure a water-tight seal. Existing systems use inflatable gaskets secured about the lid, solenoid activated valves to inflate the seal by delivering an air flow generated by a compressor, or motor driven worm gears to draw the lid against the washing chamber.

A problem with existing dishwashers is that they use cams and motors to seal the lid but they do not apply an evenly distributed load on the perimeter of the gasket. The loads are localized and they can be affected by a large dish or other item protruding above the top perimeter of the drawer.

Thus, there exists a need for a gasket seal for a dishwasher drawer which cannot be easily affected by dishes protruding above the top perimeter of the drawer, and provides an evenly distributed load for a reliable seal and a feedback system to assure a proper seal.

SUMMARY OF THE DISCLOSURE

The present disclosure relates to a cover subassembly for sealing dishwasher drawers. This disclosure further provides a method to seal the chamber space when a lid is lowered onto sidewalls of a dishwasher drawer.

A cover assembly for sealing a dishwasher drawer is provided which includes a movable cover casing that frames a flexible sealing cover, which is capable of receiving and covering tall dishes extending beyond a height of the drawer. At least one rocker arm is positioned adjacent perimeter edges of the cover casing. The rocker arms pivot about both the cover casing and a stationary frame to lower the casing over the drawer so that the sealing cover completely seals a wash chamber formed within the drawer. A seal mounted to a bottom of the cover casing presses against an upper lip of the drawer to prevent any leakage of wash fluid that is circulated in the chamber.

At least one deployment shoe protrudes outwardly from a rear edge of the cover casing to move the cover assembly when the drawer is pushed into an enclosure case. The deployment shoe extends downwardly to a block wall. The drawer contacts the block wall as it retracts inwards the enclosure case, and the resultant contact pulls the rocker arms to swing or rotate the cover casing down until the seal presses onto and seals top edges of the drawer.

At least one spring post protrudes from both the frame and the cover casing. A corresponding tension spring is secured to the protruding ends of the spring posts. The spring biases the cover assembly toward the frame.

DETAILED DESCRIPTION OF THE DISCLOSURE

The present disclosure relates to a cover subassembly for sealing dishwasher drawers. This disclosure further provides a method to seal the chamber space formed when a lid is lowered onto sidewalls of a drawer.

Figure 6:
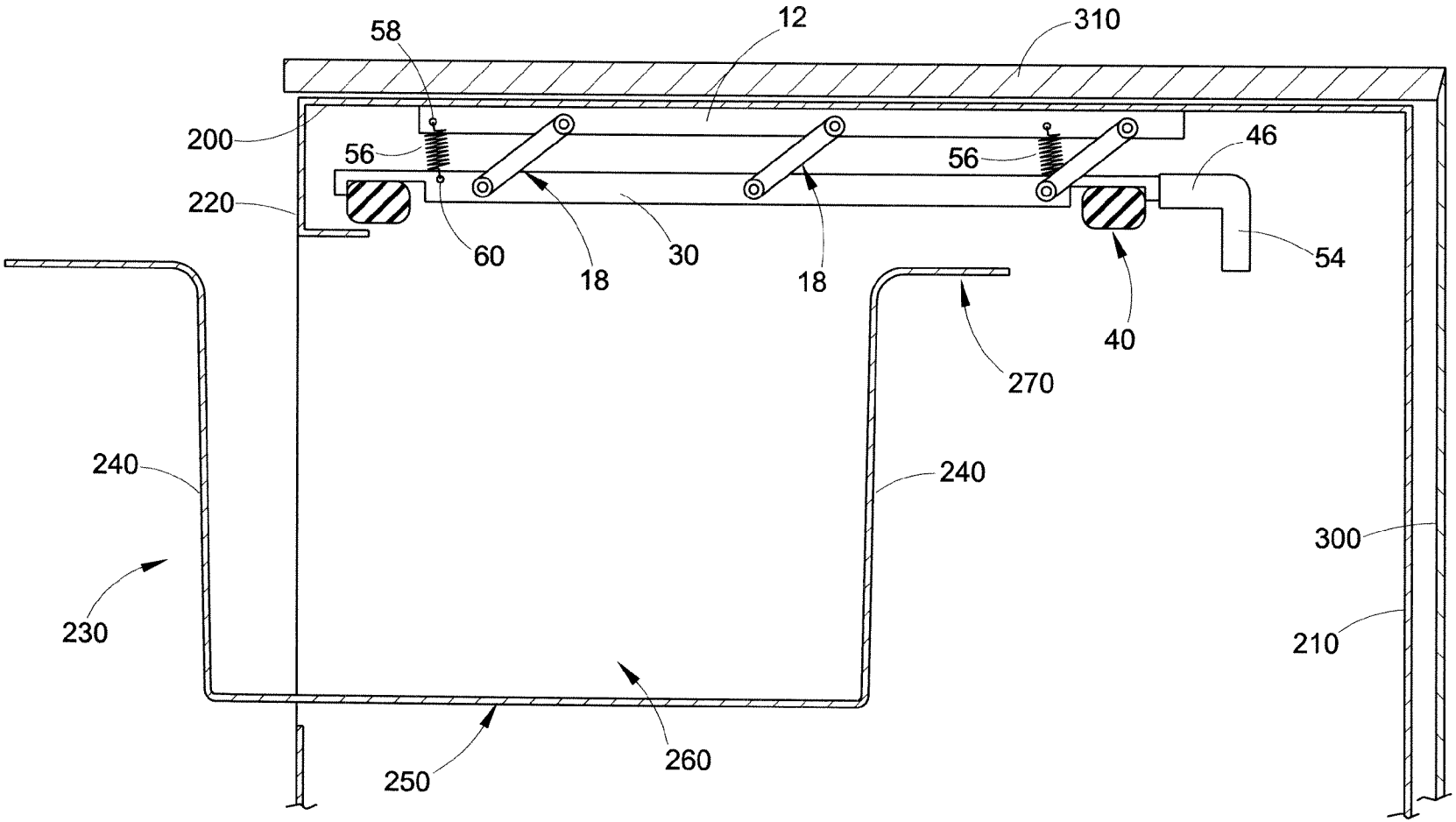
FIG. 6 is a side elevational schematic operational view in cross section of the cover assembly with the drawer extended in an opened position; and, FIG. 7 is a partial side elevational schematic operational view in cross section of the cover assembly with the drawer in a retracted closed position.

Dishwasher appliances fit into pre-fabricated cabinet spaces such that all sides of the appliance are closed and concealed from view except for the front of the dishwasher, which is made accessible to a user. Referring now to FIG. 6, the appliance includes a generally rectangular outer-metal enclosure case having opposed and parallel sidewalls, a parallel and opposed top wall 200 and a bottom wall, and a parallel and opposed rear wall 210 and a front wall portion 220. The front wall portion generally includes a door or a drawer 230 that provides access to an interior wash chamber. The rear wall 210 generally abuts a back wall 300 of a cabinet recess. The sidewalls generally abut exterior facing sidewalls of the cabinet. The top wall 200 generally abuts an underside of a countertop 310. The enclosure case houses a dishwashing chamber space and conventional control circuitry (not shown) while a pump subsystem (not shown) and a drainage subsystem (not shown) communicate with external pipes that deliver water to and return water from the wash chamber space therein.

Existing dishwashers include sealing mechanisms to ensure that there is no leakage of the water that forcefully circulates about the chamber space. Conventional door-type dishwashers utilize door seals, which are typically impermeable rubber strips that line the door panel. More recent drawer-type dishwashers include drawers which define a wash chamber and covers that close over the drawers to seal the wash chamber as they retract into the enclosure case.

Figure 1:
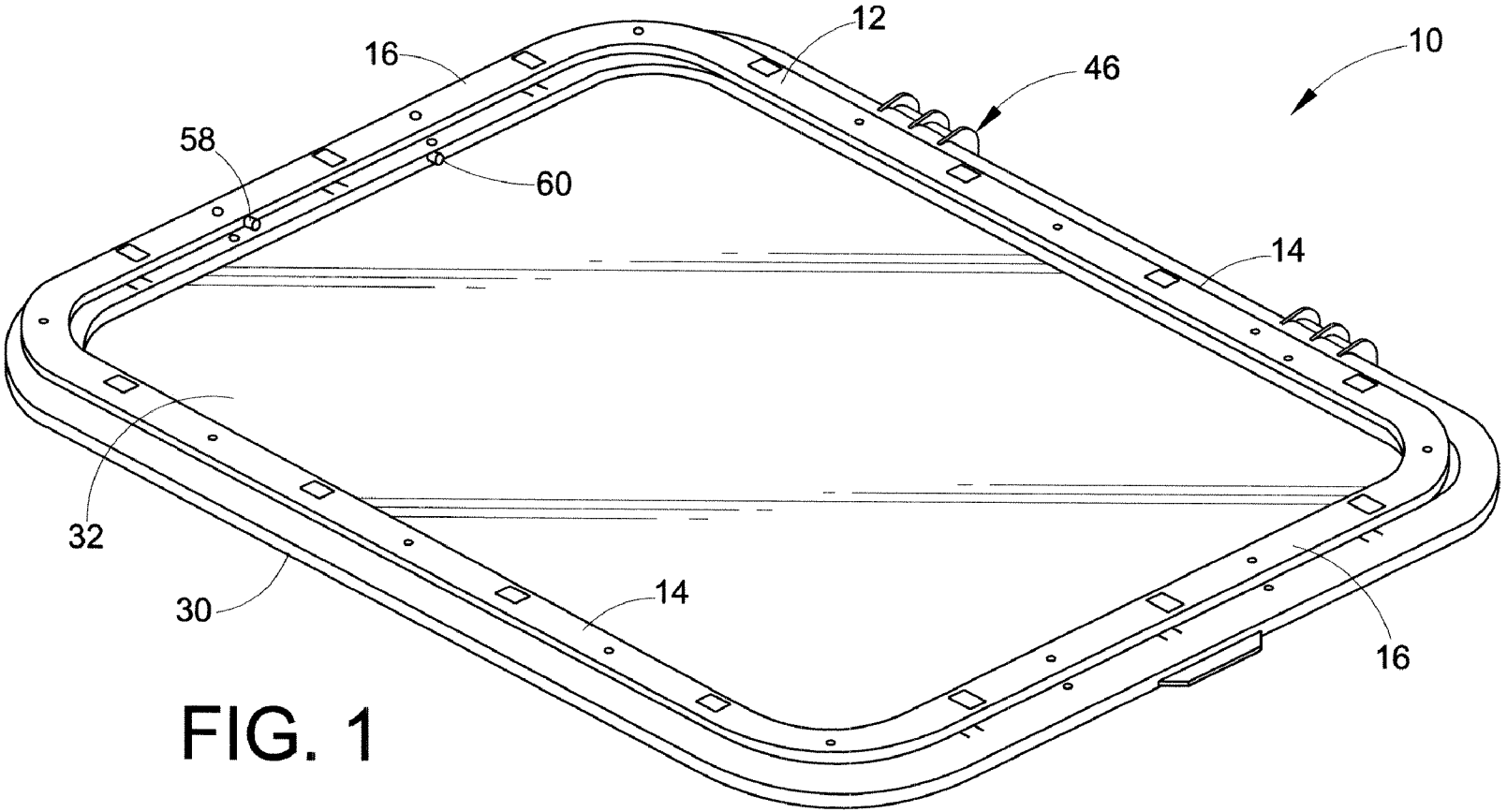
FIG. 1 is a top perspective view of a dishwasher cover assembly according to a preferred embodiment of the present disclosure.

The present disclosure provides an improved gasket subassembly 10 shown in FIGS. 1-7. FIG. 1 is an elevational top view of the dishwasher gasket subassembly 10 (hereinafter referred to as the "cover assembly") according to a preferred embodiment of the present disclosure. The cover assembly 10 is constructed for dishwasher appliances having drawers that extend outwardly from an enclosure case to make available a tub portion of the drawer to the user. The drawer utilizes conventional guide rails (not shown) to move the tub portion into and out of the enclosure for loading and unloading of the dishes placed into the tub for clearing. The guide rails mount to the interior surface of the enclosure case's sidewalls. Corresponding wheels (not shown) protrude from the exterior surface of the drawer's sidewalls to glide and slide along the guide rails. Similarly, a reverse guide rail and a corresponding wheel arrangement are used for closing the drawer. Referring now to FIG. 6, the drawer 230 itself includes four sidewalls 240 peripherally extending upwardly from a bottom wall 250 to form a tub chamber 260 (hereinafter synonymously referred to as the "tub"). A rack can be provided (not shown) within the tub for holding soiled or cleaned dishes thereon.

Referring now to FIG. 1, the cover assembly 10 includes a stationary, rigid frame 12 that affixes to the surface of interior top wall 200 of the enclosure case. FIG. 1 shows a perspective top view of the frame 12. The frame 12 corresponds generally in shape to a peripheral upper lip portion 270 (FIG. 6) formed on the tub 260. The frame is generally rectangular, having two parallel opposing long edges 14 and two parallel opposing short edges 16. Long edge 14 and short edge 16 may be of equal or different lengths. The frame 12 is screwed onto or otherwise fastened to the enclosure case in the present embodiment, but the disclosure is not limited to any one method of attachment.

Figure 2:
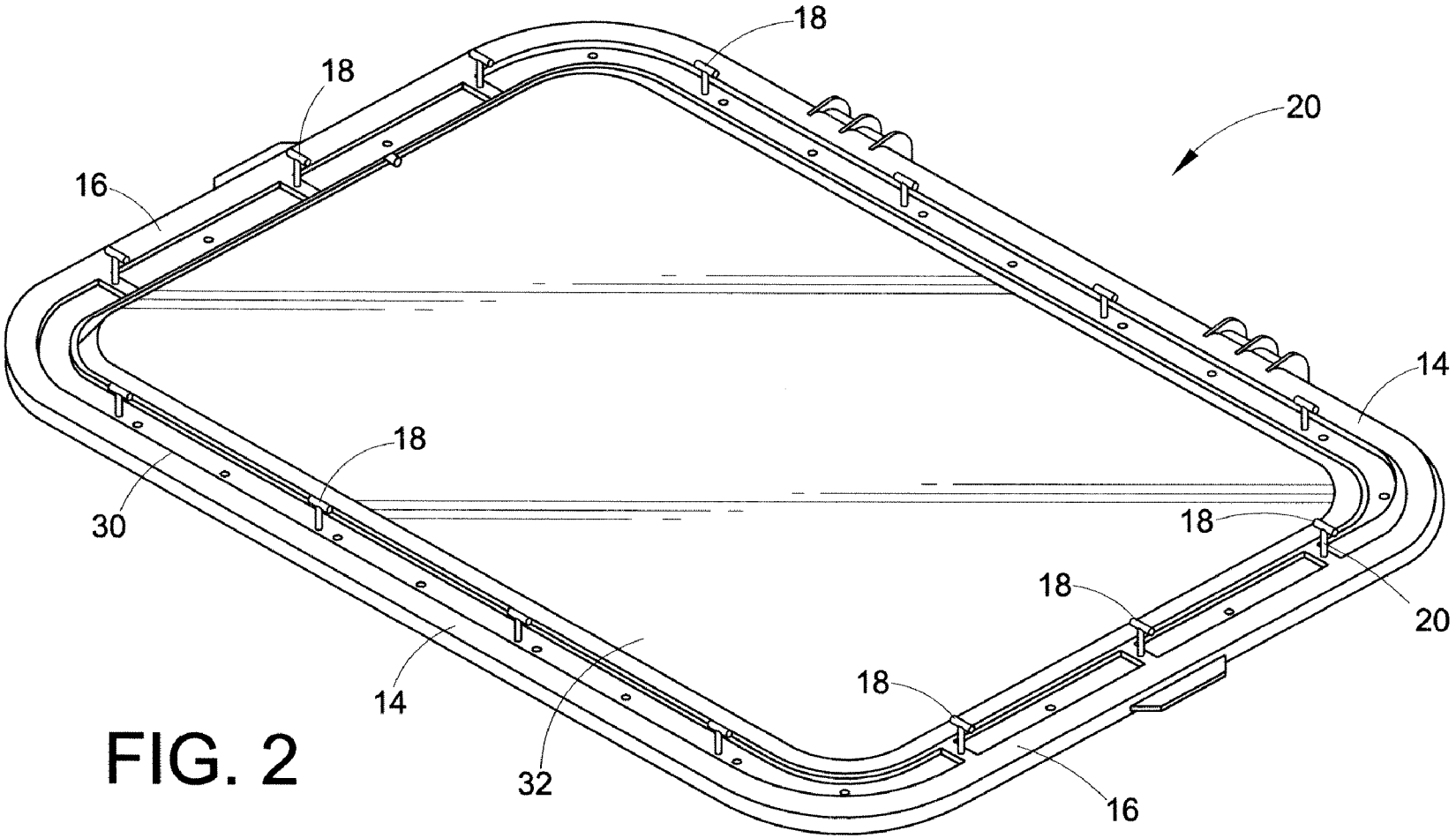
FIG. 2 is a top perspective view of the dishwasher cover assembly without a stationary frame.

Referring now to FIG. 2, a plurality of rocker arms 18 are spaced along both long edges 14 and short edges 16 such that they are positioned and distributed about an entire perimeter of the frame 12. The rocker arms 18 are shown evenly distributed about the perimeter of the frame in FIGS. 1 and 2, but they can be unevenly spaced as well. Preferably, at least three rocker arms 18 protrude from each edge 14, 16. A first rocker arm is positioned near a first distal end, a second rocker arm is positioned near an opposing second distal end, and a third rocker arm is centrally positioned along edges 14, 16. Other embodiments may include at least two or more additional rocker arms 18 positioned along each edge. Further embodiments may alternatively include additional rocker arms 18 positioned near one or both distal ends of the edges. The preferred embodiment includes at least fourteen rocker aims 18 spaced along edges 14, 16.

Figure 3:
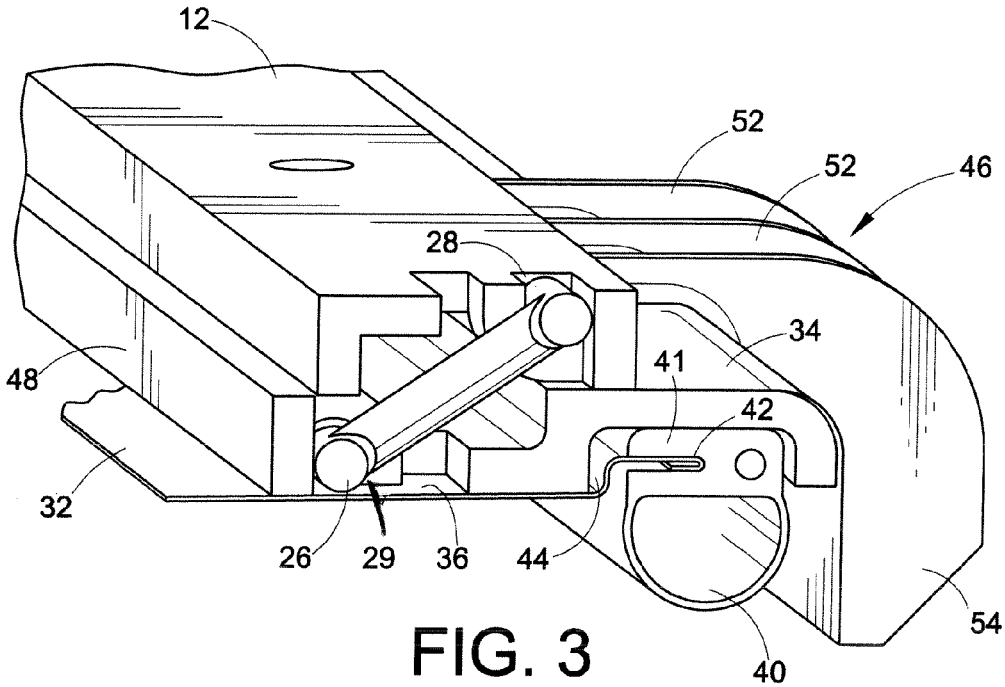
FIG. 3 is a partial perspective view of a rocker arm system when the drawer is open.
Figure 4:
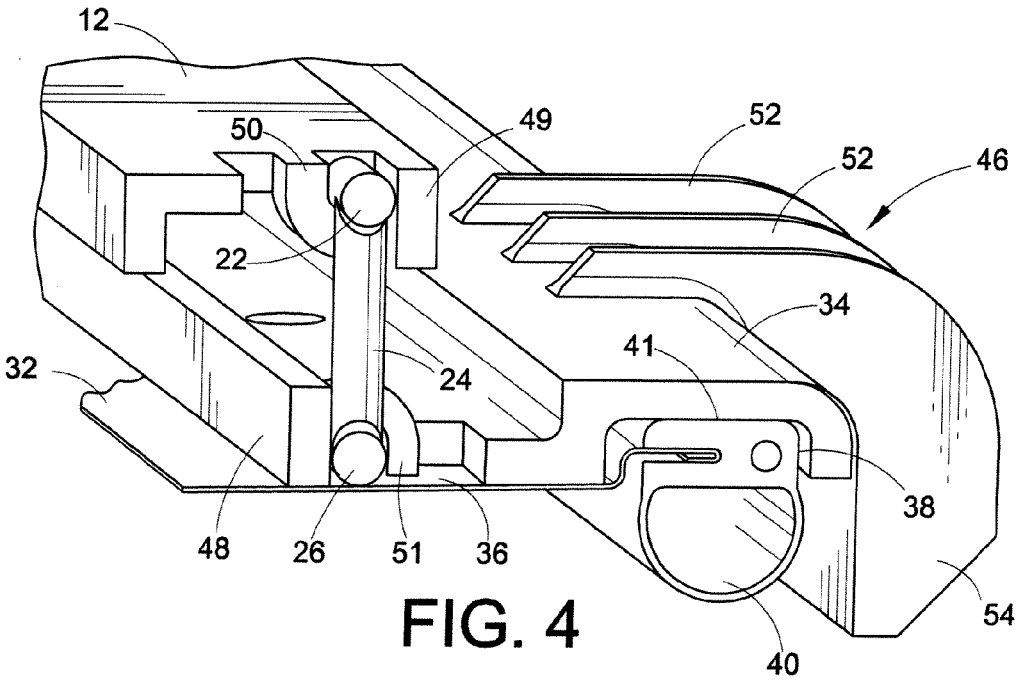
FIG. 4 is a partial perspective view of the rocker aim system when the drawer is closed.
Figure 5:
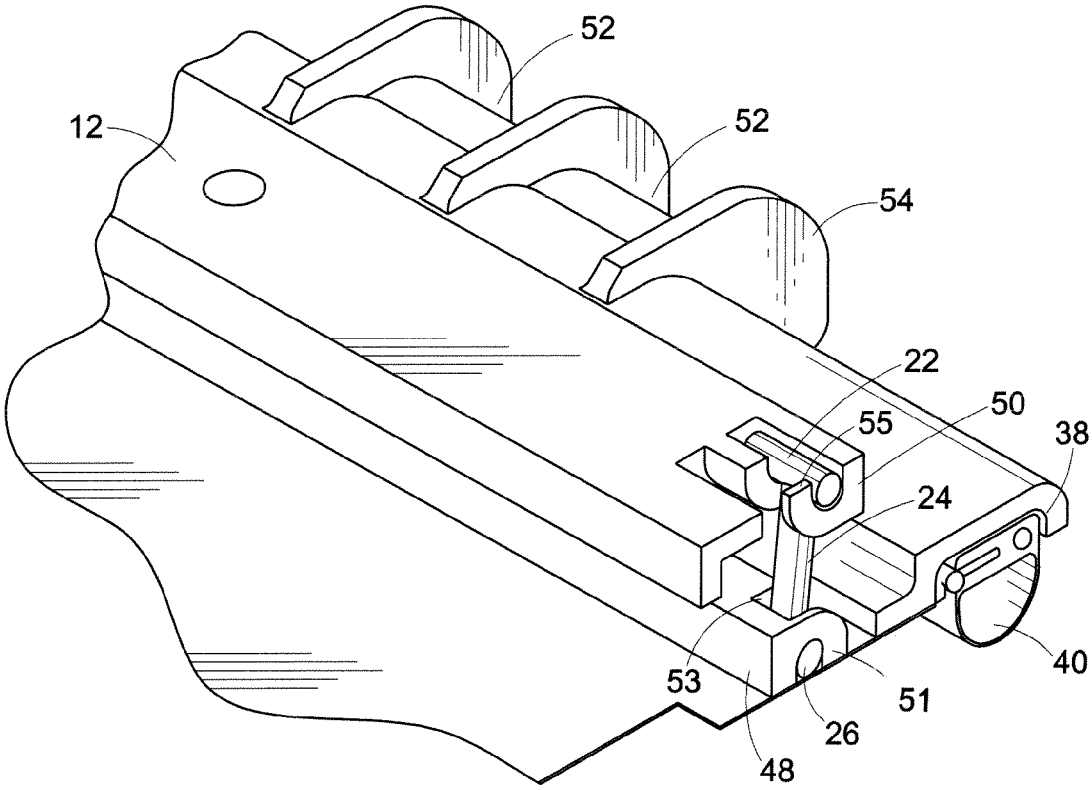
FIG. 5 is a top perspective view of the rocker arm system of FIG. 4.

Referring now to FIGS. 3, 4 and 5, the rocker arms 18 each have a substantially I-shaped member including an upper bar 22, a lower bar 26, and a leg 24 substantially perpendicular to each bar. Horizontal bars 22, 26 turn axially in pockets 28, 29 while leg 24 pivots as the top sealing surface is raised or lowered. The bar 22 remains substantially parallel to a horizontal plane of the frame as it moves, but the leg 24 pivots forward from a vertical position (in FIG. 3) and returns to a substantially vertical position (in FIG. 4). The rocker arms 18 are oriented such that they all pivot at substantially the same time. Spacing of the rocker aims 18 is shown in FIG. 1, but a view of the arms is obstructed by the top face of the frame 12. The rocker arms 18 protrude from an underside of the frame 12. The rocker arms 18 move cover element 20 directly over or away or offset from the tub of the drawer; hence, they must be similarly oriented so that their rotational trajectories occur in unison. FIG. 2 is a partial view of the movable cover assembly 20.

Referring now to FIGS. 3 and 4, pockets 28, 29 formed in the frame's undersurface receive corresponding bar portions 22, 26 of the rocker arms 18. Bar 26 pivots about corresponding pocket 29 formed in a movable, rigid frame cover (hereinafter referred to as "cover casing 30"). The bar 26 is substantially parallel to the bar 22. Neither the bar 26 nor the bar 22 move away from the cover casing 30 or the stationary frame 12 that contain them; rather, they pivot or rotate within their respective pockets 28, 29 so that the leg member 24 moves the cover casing toward and away from the frame 12. In other words, the cover casing 30 and the frame 12 remain oriented in two, parallel, generally horizontal planes: the frame remains in a fixed plane and the cover casing moves in several horizontal planes away from and toward the frame. The leg member 24 rotates to change a distance or gap between the cover casing 30 and the frame 12, as seen in FIGS. 3 and 4.

The cover casing 30 borders a perimeter of a sealing cover 32 (FIG. 2). FIG. 2 shows movable parts of the cover assembly 10, in the closed position corresponding to that illustrated in FIGS. 4 and 7, wherein the cover casing 30 is moved rearwardly and downwardly relative to frame 12, to sealingly engage the lip 270 of the tub 260 (FIG. 7) so that the sealing cover 32 can completely close and seal the tub chamber therein. One aspect of the present sealing cover 32 is that it is formed of resilient material; that is, it is made from a material that offers some flexibility to deform sufficiently to accommodate a height of a dish which extends above a height of the drawer's sidewalls 240.

A recurring cause of leakage in existing dishwashers is a compromised or broken seal. More specifically, a large dish or an overstuffed rack can compromise or break the seal. The present embodiment uses a pliant or flexible sealing cover 32 that receives and covers the portions of dishes extending beyond the drawer's top edge. Existing dishwasher covers are typically rigid; they must rely on pins that engage u-shaped slots of toggles to move. The pins are typically positioned on one edge of the frame and the cover casing's perimeters. These pin-and-slot assemblies depend on both stiffness and the planarity of the cover arrangement.

The present cover assembly 10 overcomes the stiffness and planarity limitations inherent in existing covers. Since the cover assembly 10 does not utilize a structurally rigid cover, the rocker arms 18 can be positioned about the entire cover casing's perimeter. Furthermore, the pliable or flexible sealing cover 32 is manufactured from a lighter weight and a thinner material than existing covers, such as for example thin plastic or stainless steel, so there is less force required to lift the cover element 20 and less friction created by movement of the cover element.

Operation of the foregoing components is best understood with reference to the partial perspective views shown in FIGS. 3, 4 and 5. FIG. 3 shows a rocker arm 18 assembly in an extended, open drawer position, and FIG. 4 shows the rocker arm assembly in a retracted, closed drawer position. The cover casing 30 includes an outer elevated portion 34 and an inner recessed portion 36. The rocker arms 18 are nestled in the pockets or depressions 29 formed in a top or upper surface of the inner portion 36.

Referring to FIGS. 3-5, a groove 38 is formed along the underside of the elevated portion 34. A seal 40 is formed of impermeable material, such as rubber, and is positioned within and extends from groove 38. The seal 40 is similar to those that line doors of existing dishwashers. The seal 40 adheres to wall 41 of the groove by means of a permanent or a removable adhesive, or any other suitable means of attachment. A slit 42 is formed through an inside portion of the seal 40 and captures a correspondingly shaped planar component or edge 44 of the sealing cover 32. The sealing cover is secured to the cover casing member 30 by attachment of the seal to wall 41. The seal 40 is the lowermost exposed component in the cover assembly 10, with the exception of deployment shoes 46, which are discussed later.

FIGS. 3 and 6 show the position of the cover casing 30 relative to the frame 12 when the cover seal assembly is in its open position. The cover casing 30 is positioned closely adjacent to the stationary frame 12. In this position the top surface of the cover casing 30 contacts or nearly contacts the underside surface of the frame 12. The rocker arms 18 are shown in the FIGS. 3 and 5 to extend at an approximately 30-degree angle from the horizontal planes in which the frame 12 and the cover casing 30 are oriented and positioned. The rocker arms 18 pivot or rotate about both the bars 22, 26 to pull the cover casing 30 upwards.

Figure 7:
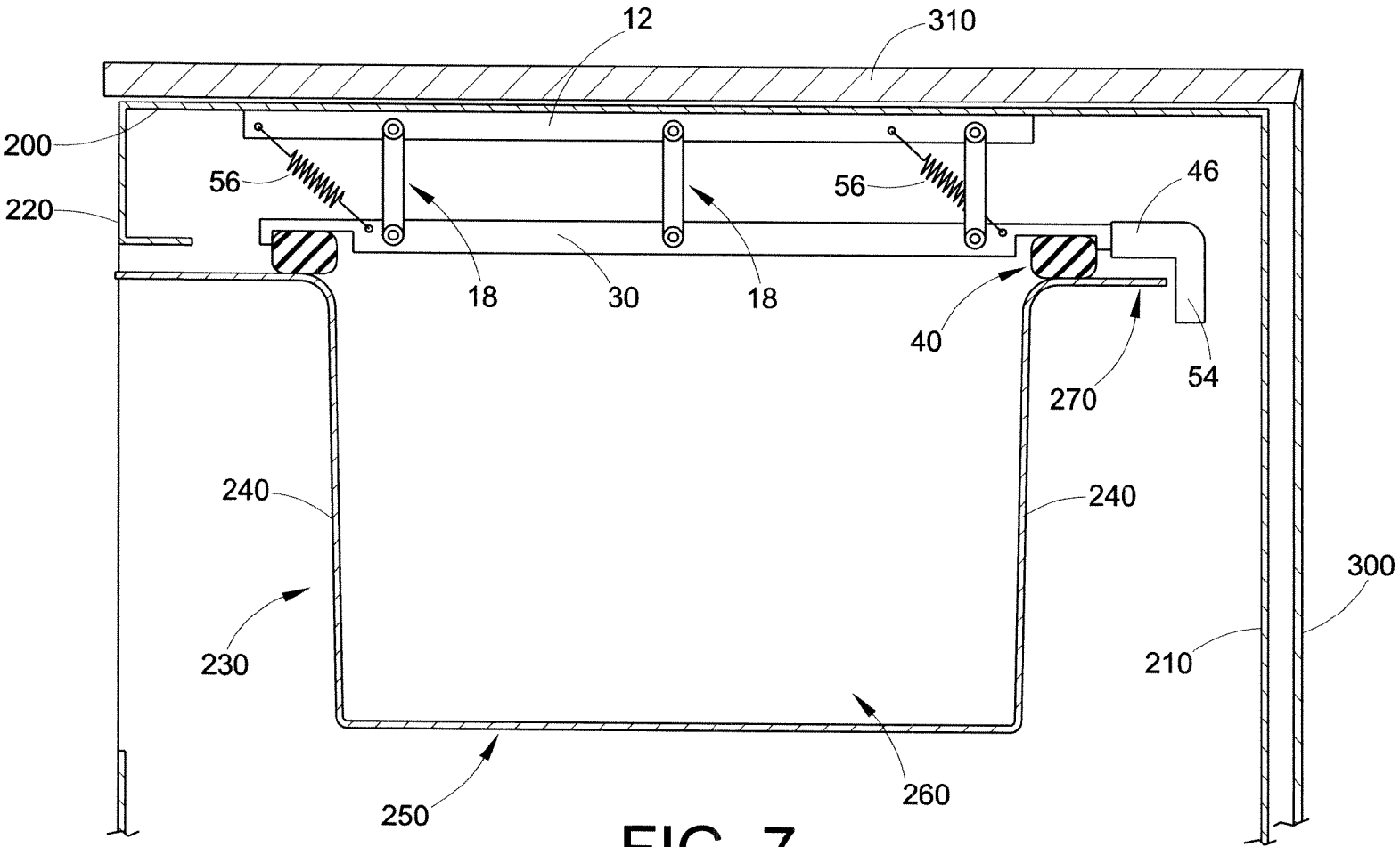

FIGS. 4 and 7 show the position of the cover casing 30 relative to the frame 12, when the cover seal assembly is in its closed position remote or spaced apart from the frame 12. The rocker arms 18 are shown in a substantially vertical position, i.e., substantially perpendicular to both the cover casing 30 and the frame 12. As will hereinafter be described in greater detail, as the dishwasher drawer 230 moves from its withdrawn position to its retracted or closed position, it moves the cover assembly 10 in an inward direction from its open position toward its closed position. Because of the rocker arm linkage of the cover casing 30 to the stationary frame 12, as the rocker arms 18 pivot, the cover assembly 10 moves inwardly and downwardly to its closed position in such close proximity to the dishwasher drawer 230 that the seal 40 is pushed into sealing engagement with the lip 270 of the tub 260 to seal the gap between the cover assembly 10 and the drawer 230.

Each rocker arm 18 pivots at both bars 22 and 26; however, movement of the arm is limited by a vertically oriented retaining wall 48. The retaining wall 48 is congruent with the sidewall of the inner depressed portion 36. The retaining wall extends to about a same or a lower height than the elevated frame portion 34. The retaining wall precludes the rocker arm 18 from pivoting past a vertical 90-degree angle from the plane in which the cover casing 30 is positioned.

As can be best seen in FIGS. 3 and 4, pockets 28, 29 that contain the bars 22 and 26 both include a retaining wall 48, 49. A curved, front wall 50, 51 accommodates the cylindrical portion of the bar 22 and the bar 26. The walls 50, 51 have recesses 53, 55 for accommodating the legs.

At least one deployment member or shoe 46 extends over the cover casing 30 to move the cover assembly 10 when the drawer is pushed into the enclosure case. The tub 260 contacts the deployment shoe(s) 46 as it retracts inwardly, and the contact causes the rocker arms 18 to swing the cover 32 down until the seal 40 contacts against an upper surface of the drawer lip 270. The deployment shoe(s) 46 includes generally horizontal fingers 52 that extend downwardly to form a vertically extending block wall 54. The fingers 52 protrude beyond the lowermost region of the cover casing 30. Each finger 52 ensures that the block wall 54 extends downwardly past the outermost region of the cover casing 30 and past an outermost portion of the seal 40 to extend beyond the path of the lip portion 270 of the drawer's rear sidewall 240.

As the drawer is moved from its open position to its closed position, the lip portion 270 which projects rearwardly of the drawer's rear sidewall 240, contacts the block wall 54. The force used to drive the drawer is translated to the block wall 54, which in turn results in a continued, rearward movement of the block wall. The deployment shoes are integral to the cover casing 30, so their movement causes rearward movement of the entire cover casing. This movement pulls the bars 26, causing the rocker arms 18 to pivot at both the cross bar and the bar 22. Pivoting movement of the rocker arms 18 continues until the legs 24 rotate counter clockwise and contact the retainer wall 48.

As best seen in FIGS. 5 and 7, the cover casing is biased to its open position, that is the position closest to frame 12 by tension springs 56. When the closing force applied to the drawer, transferred to the deployment shoes 46, when engaged by lip 270, is sufficient to overcome this spring force the sealing cover 32 pivots downwardly and inwardly onto the tub 260. The tension springs 56 provide the force to pull the sealing cover 32 upwardly and away from the tub 260 when the drawer moves toward its open position. FIG. 1 shows at least one spring post 58 protruding inward from contact with the frame's short edge 16. A first distal end of the tension spring 56 is installed on this post, while the opposing distal end of the spring affixes to a corresponding post 60, which similarly extends from the lower portion of the cover casing 30. The tension spring 56 is shown as a coil spring that extends and compresses as the drawer respectively opens and closes, but any other suitable biased mechanism may be used that is capable of storing energy by stretching, such as for example, a durable elastic band.

The tension posts 58, 60 are oriented on both the frame 12 and the cover casing 30 to position the spring 56 in a nearly vertical position when the sealing cover 32 is lifted up and away from the tub 260. When the rear drawer sidewall 240 (i.e., the lip 270) contacts the block wall 54 of the deployment shoes 46, it causes the spring 56 to extend as the cover casing 30 is lowered towards the tub 260 (FIG. 6). The rocker arms are in a substantially vertical position. The rear lip 270 of the tub 260 pushes against the block wall 54, and the force of which overcomes the spring force. The tension spring 56 then returns to its vertical position when the drawer's rear lip 270 moves away from the deployment shoe 46 (FIG. 5).

A particular advantage provided by the present cover assembly 10 is that it permits utilization of a pliable or flexible cover; hence, neither the entire cover system nor movement of the cover assembly is impeded by tall dishes. Because this embodiment obviates a necessity for a structurally stiff top assembly, its manufacture does not require precision parts with respect to planarity. The sealing cover is made of a lighter weight, so the load required to actuate the cover assembly is reduced; hence, the entire cover assembly system is easier to operate and manufacture.

What is claimed is:

1. A cover assembly for a dishwasher drawer comprising:

a stationary frame affixed to an interior top wall surface of an enclosure case of said dishwasher drawer;

a movable cover casing framing a flexible sealing cover; and a plurality of rocker arms distributed about a perimeter of said frame pivotally linking said cover casing to said frame for movement between an open position remote from the drawer and a closed position in sealing engagement with the drawer, wherein each of said rocker arms includes:

a substantially I-shaped member including a first bar contained in a recess on an underside of said frame;

a second bar contained in a corresponding recess on an upper surface of said cover casing, wherein said second bar is substantially parallel to said first bar;

a leg substantially perpendicular to both on said first bar and said second bar such that said leg protrudes from said underside of said frame and from said upper surface of said cover casing;

wherein both said first bar and said second bar rotate in said respective recesses so that said leg moves said cover casing toward and away from said frame;

wherein both said second bar and said first bar remain in horizontal planes of said cover casing and said frame.

2. The cover assembly of claim 1, including at least twelve rocker aims wherein at least three rocker arms are included on each edge of said frame, and wherein each of said rocker arms are oriented so that they pivot in unison.

3. The cover assembly of claim 1, wherein said cover casing comprises:

an outer, elevated portion; an inner, depressed portion; and a groove extending along an underside of said elevated portion; and a seal adhered to a bottom wall of said groove and protruding outwards therefrom.

4. The cover assembly of claim 3, wherein in said closed position said rocker aims push said seal into sealing engagement with a lip of the drawer to provide a seal between said cover assembly and said drawer.

5. The cover assembly of claim 4, further comprising a retaining wall congruent with a sidewall of said inner depressed portion, said retaining wall prevents said leg of said rocker arm from travelling past a 90-degree angle.

6. The cover assembly of claim 1, further including at least one deployment member that protrudes outwardly from a rear edge of said cover for engagement by the drawer when the drawer is moved into the enclosure case.

7. The cover assembly of claim 6, wherein said at least one deployment member includes a block wall, said block wall extends downwardly past an outermost region of said cover into the path of the drawer.

8. The cover assembly of claim 7, wherein the drawer contacts said block wall as it retracts inwardly within the enclosure case, wherein said rocker aims swing said cover casing downwardly until said seal is lowered onto presses onto top edges of the drawer.

9. The cover assembly of claim 1, further comprising:

at least one spring biasing member operative to bias said sealing cover toward its open position.

10. The cover assembly of claim 9, wherein said biasing member comprises at least one tension spring which extends when said cover casing is moved toward its closed position.

11. The cover assembly of claim 1, wherein said recesses comprise pockets including:

a front wall that accommodates said first bar and said second bar; and at least one recess within said front wall to accommodate said leg as said leg rotates.

12. A cover assembly for sealing the wash chamber of a dishwasher drawer removably contained in an appliance enclosure case, said cover assembly comprising:

a rigid, movable cover casing framing a pliable sealing cover;

at least one rocker arm mounted on perimeter edges of said cover casing;

a stationary, rigid frame affixed to an interior top wall surface of said enclosure case, wherein said rocker arm pivots between said frame and said cover casing to lower said cover casing over the drawer so that said sealing cover seals the wash chamber within the drawer, wherein each rocker arm includes:

a first bar contained in a pocket on an underside of said frame;

a second bar contained in a pocket on an upper surface of said cover casing, wherein said second bar is substantially parallel to said first bar;

a leg substantially perpendicular to both said first bar and said second bar such that said leg protrudes from said underside of said frame and from said upper surface of said cover casing;

wherein both said first bar and said second bar pivot in said respective pockets so that said leg moves said cover casing toward and away from said frame;

wherein both said second bar and said first bar remain in a horizontal plane of said cover casing and said frame, said leg pivots between an angled portion and a substantially vertical position;

whereby said rocker arms in said vertical position press a seal of said cover assembly into sealing engagement with a lip of said drawer to seal the gap between said cover assembly and said drawer.

13. The cover assembly of claim 12, comprising a plurality of rocker arms, wherein at least three rocker arms are included on each said edge of said cover casing, wherein each of said rocker arms are oriented so that they pivot in unison.

14. The cover assembly of claim 12, wherein said cover casing comprises:

an outer, elevated portion; an inner, depressed portion; a groove extending along an underside of said elevated portion; and, a seal adhered to a bottom wall of said groove and protruding outwardly therefrom.

15. The cover assembly of claim 14 further including a retaining wall congruent with a sidewall of said inner depressed portion, said retaining wall precludes a leg of said rocker arm from travelling past a 90-degree angle.

16. The cover assembly of claim 12, further including at least one deployment member that protrudes outwardly from a rear edge of said cover casing to move said cover assembly when the drawer moves into the enclosure case.

17. The cover assembly of claim 16, wherein said at least one deployment member includes a block wall, said block wall extends downwardly past an outermost region of said cover casing and below an edge of said seal.

18. The cover assembly of claim 17, wherein the drawer contacts said block wall as it retracts inwardly within the enclosure case, wherein said rocker aims swing said cover casing inwardly and downwardly until said seal sealingly engages the drawer.

19. The cover assembly of claim 12, wherein said pockets include:

a curved front wall that accommodates a cylindrical configuration of said first bar and said second bar; and, a recess formed in said curved front wall to accommodate said leg.

20. A cover assembly for sealing the wash chamber of a dishwasher drawer removably contained in an appliance enclosure case, said cover assembly comprising:

a rigid, movable cover casing framing a pliable sealing cover;

at least one rocker arm mounted on perimeter edges of said cover casing;

a stationary, rigid frame affixed to an interior top wall surface of said enclosure case, wherein said rocker arm pivots between said frame and said cover casing to lower said cover casing over the drawer so that said sealing cover seals the wash chamber within the drawer;

at least one spring post protruding from said frame;

at least one corresponding spring post protruding from said cover casing; and, at least one tension spring which pulls said sealing cover upwardly and away from the drawer.

21. The cover assembly of claim 20, wherein said tension spring extends when said cover casing moves toward the drawer.

* * * * *